US009644821B2

(12) United States Patent
Zhang

(10) Patent No.: US 9,644,821 B2
(45) Date of Patent: May 9, 2017

(54) MOUNTING CARRIER FOR A BULB

(71) Applicant: GEMMY INDUSTRIES CORPORATION, Coppell, TX (US)

(72) Inventor: Cheng-Chun Zhang, Shenzhen (CN)

(73) Assignee: GEMMY INDUSTRIES CORPORATION, Coppell, TX (US)

( * ) Notice: Subject to any disclaimer, the term of this patent is extended or adjusted under 35 U.S.C. 154(b) by 266 days.

(21) Appl. No.: 14/341,111

(22) Filed: Jul. 25, 2014

(65) Prior Publication Data

US 2016/0025309 A1 Jan. 28, 2016

(51) Int. Cl.
*F21V 21/008* (2006.01)
*F21V 21/088* (2006.01)
*F21V 21/08* (2006.01)

(52) U.S. Cl.
CPC ..... *F21V 21/08* (2013.01); *F21V 21/008* (2013.01); *F21V 21/0824* (2013.01); *F21V 21/0885* (2013.01); *F21V 21/0832* (2013.01)

(58) Field of Classification Search
CPC .. F21V 21/08; F21V 21/0824; F21V 21/0832; F21V 21/088; F21V 21/0885; F21V 21/008
USPC ... 248/205.1, 220.21, 222.13, 223.41, 224.8, 248/225.11
See application file for complete search history.

(56) References Cited

U.S. PATENT DOCUMENTS 131,298 A * 9/1872 Polley ..... A47B 95/008 24/364
266,446 A * 10/1882 Eager ..... A47B 96/061 248/223.41
327,939 A * 10/1885 Garrison ..... A47B 57/42 248/222.13
469,216 A * 2/1892 Quinn ..... A47F 5/0037 211/181.1
487,594 A * 12/1892 Ackerman ..... A47F 5/103 211/106.01
549,049 A * 10/1895 Batty ..... F16M 11/00 211/88.01
1,286,376 A * 12/1918 Madsen ..... A47K 10/10 126/332
1,625,163 A * 4/1927 Schurr ..... A47G 23/0225 248/222.13
2,156,025 A * 4/1939 Paul ..... A24F 19/0092 211/107
2,456,792 A * 12/1948 Ohm ..... F21S 8/04 248/222.13
3,045,961 A * 7/1962 Cygan ..... A47F 5/0846 248/220.42
3,540,687 A * 11/1970 Cuva ..... F21V 19/0005 248/223.41

(Continued)

*Primary Examiner* — Michael Safavi
(74) *Attorney, Agent, or Firm* — Hershkovits & Associates, PLLC; Abe Hershkovitz

(57) ABSTRACT

A mounting carrier for a bulb has a fastener and a mounting unit, the fastener has an engaging portion and a holding ring, and the engaging portion has a slant protrusion. The mounting unit connects to the fastener and has a connecting portion having at least one blocking lump and a fastening hole, the engaging portion is held and limited by the blocking lump, and the fastening hole is fastened with the slant protrusion of the engaging portion. In use, the bulb is clamped by the holding ring, so that the bulb can be hung on a wall for illumination.

6 Claims, 7 Drawing Sheets

(56) References Cited

U.S. PATENT DOCUMENTS 3,807,675 A * 4/1974 Seckerson ..... F16L 3/13 24/337
3,915,189 A * 10/1975 Holbrook ..... A61M 1/0001 137/205
3,927,315 A * 12/1975 Werry ..... F21S 4/10 248/223.41
4,061,299 A * 12/1977 Kurosaki ..... F16L 3/1203 248/222.12
4,133,509 A * 1/1979 Kalbow ..... A47K 1/09 248/221.11
4,936,533 A * 6/1990 Adams ..... B60R 1/04 248/222.11
4,976,357 A * 12/1990 Pearson ..... A47F 7/021 211/107
4,989,815 A * 2/1991 McAuley ..... A47F 5/0846 211/59.1
5,332,183 A * 7/1994 Kagayama ..... B62J 11/00 224/420
5,577,779 A * 11/1996 Dangel ..... E05C 19/06 220/326
5,597,229 A * 1/1997 Plichta ..... F21V 21/0824 362/153.1
5,806,822 A * 9/1998 Schulz ..... A61B 90/50 211/70.6
5,904,325 A * 5/1999 Hung ..... F16L 3/04 24/702
6,438,808 B1 * 8/2002 Kung ..... A45F 5/02 24/3.11
6,698,700 B2 * 3/2004 Moerke ..... F16B 21/06 248/220.31
8,302,923 B2 * 11/2012 Johnston ..... A47F 5/0823 211/57.1
8,500,078 B2 * 8/2013 Castellanos ..... A47B 96/06 211/87.01
2005/0099802 A1 * 5/2005 Lai ..... F21S 8/081 362/153
2010/0165612 A1 * 7/2010 Yeh ..... F21V 21/0885 362/190
2011/0108691 A1 * 5/2011 Alves ..... G09F 3/204 248/223.41
2012/0298813 A1 * 11/2012 Gibbons ..... F16M 13/022 248/201
2013/0015288 A1 * 1/2013 Hernandez ..... F16B 2/245 244/3.1

* cited by examiner

MOUNTING CARRIER FOR A BULB

BACKGROUND OF THE INVENTION

1. Field of the Invention

The present invention relates to a mounting carrier, especially a mounting carrier for a bulb that can be mounted on various terrains.

2. Description of the Prior Arts

Lamps have been developed for a long time with multiple application patterns in daily life, such as street lamps that illuminate on a large area, vehicle lamps that illuminate to the long distance by concentrating the light source, advertisement lamps with colorful illumination and indoor lamps that illuminate the space in a building.

The indoor lamps are always shaped as a light tube or a bulb. The light tube is mounted mostly in offices due to the high illumination, but the light tube needs to be installed with a lamp holder. Thus, the light tube is difficult to disassemble and occupies much of the interior space of the building. The conventional bulb has a connecting base, a luminous module and a transparent housing. The connecting base is made of conductive materials and the luminous module is connected electrically with the connecting base. The transparent housing is mounted on a top side of the connecting base and covers the luminous module. The bulb with tiny volume is used mostly in households because of ease of installation and disassembly. However, the connecting base of the bulb needs to be connected with a power socket located on the indoor wall, so the application of bulb is limited.

To overcome the shortcomings, the present invention provides a mounting carrier for a bulb to mitigate or obviate the aforementioned problems.

SUMMARY OF THE INVENTION

The main objective of the present invention is to provide a mounting carrier for a bulb for expanding the applications of the bulb.

The mounting carrier for a bulb comprises a fastener and a mounting unit, the fastener has an engaging portion and a holding ring, the engaging portion is mounted on one end of the fastener and has a slant protrusion formed on the bottom side of the engaging portion, and the holding ring is mounted on the other end of the fastener. The mounting unit connects to the fastener and has a connecting portion mounted on one end of the mounting unit, the connecting portion has at least one blocking lump and a fastening hole, each one of the at least one blocking lump is formed on the connecting portion, the engaging portion is held and limited by the blocking lump, and the fastening hole is formed on a top of the connecting portion and fastened with the slant protrusion of the engaging portion.

The holding ring of the fastener is used for holding a conventional bulb, and then connecting the engaging portion with the connecting portion of the mounting unit. The mounting unit can be a hook, so the bulb can be hung on a wall and supplied with electricity via a wire. The advantages of the present invention include ease of mounting and disassembly and expansion of the applications of the bulb.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
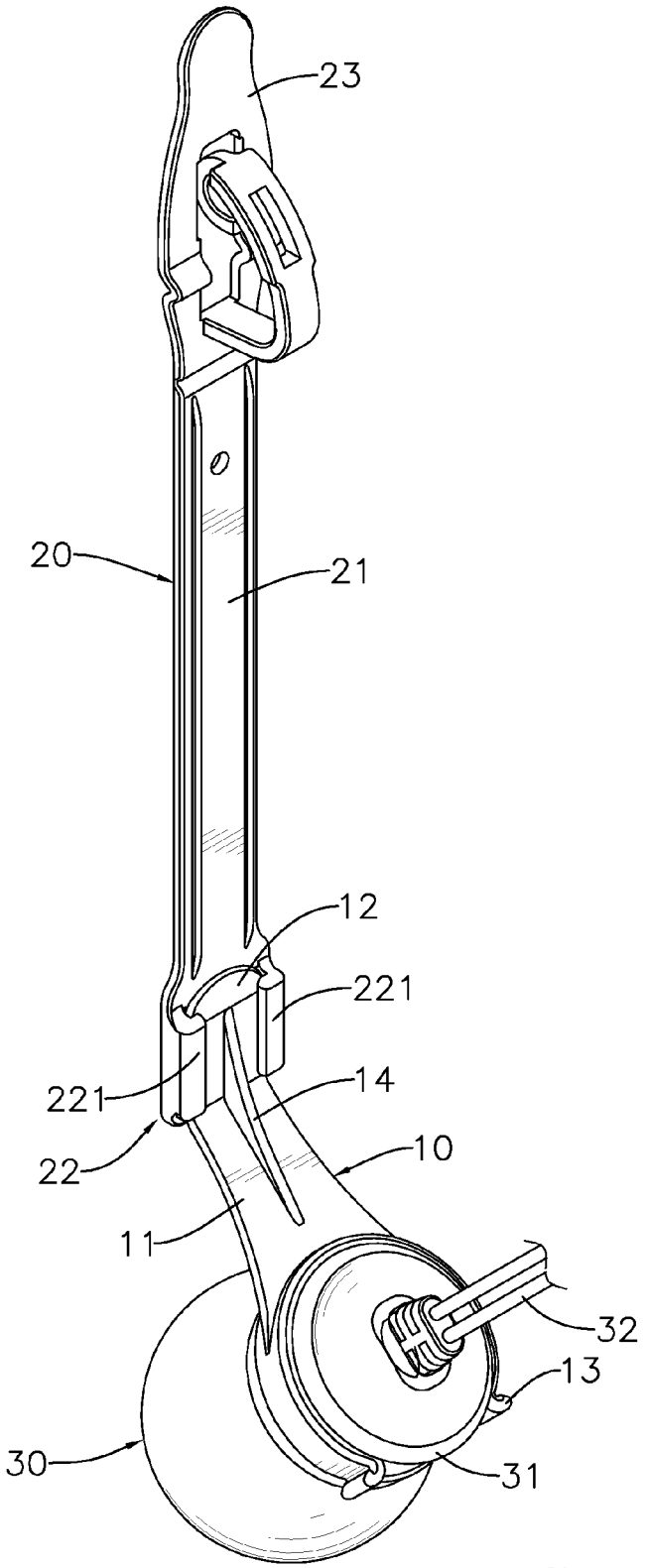
FIG. 1 is a perspective view of a first embodiment of a mounting carrier for a bulb in accordance with the present invention.
Figure 6:
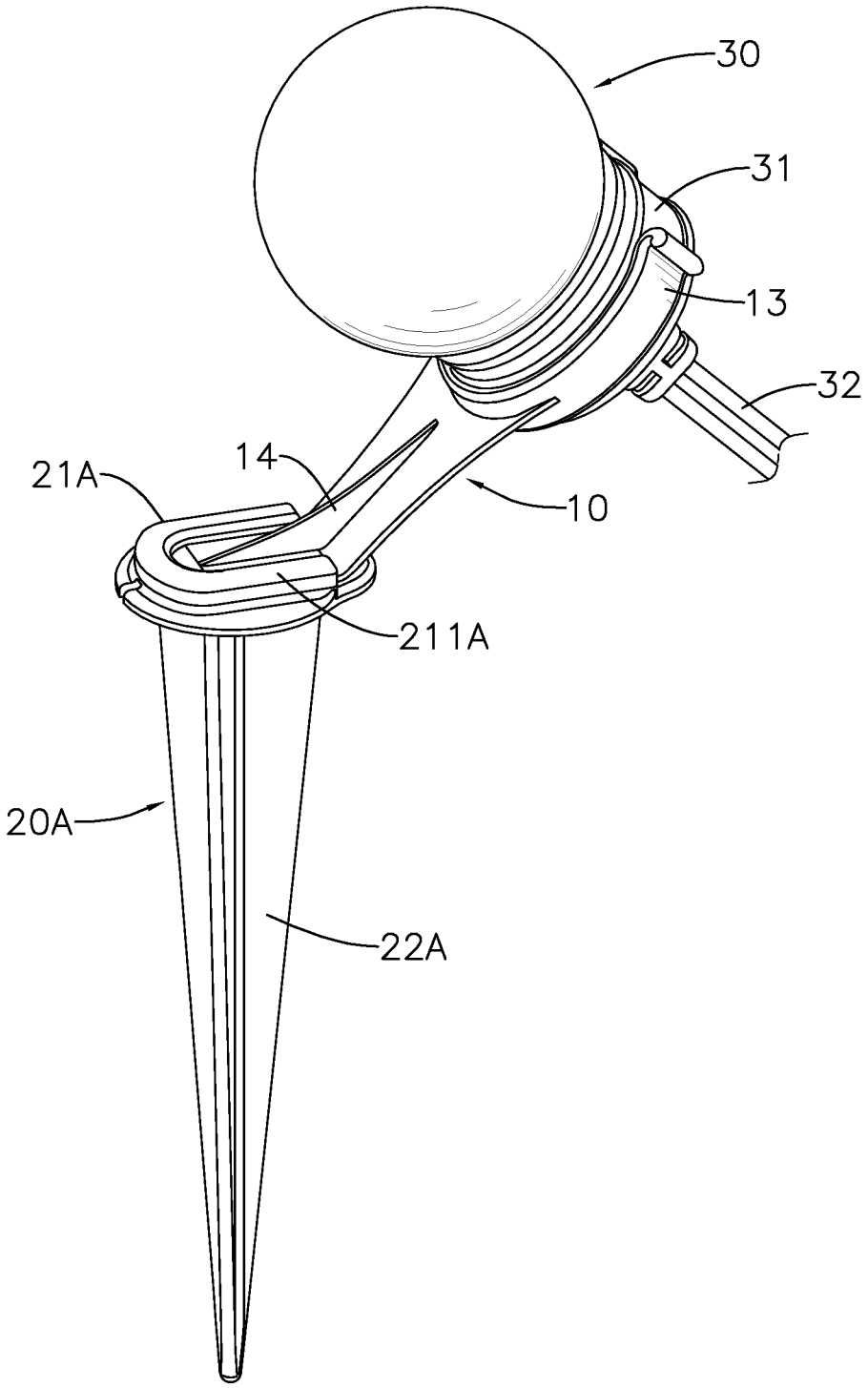
FIG. 6 is a perspective view of a second embodiment of the mounting carrier for a bulb in accordance with the present invention.

With reference to FIGS. 1 and 6, a mounting carrier for a bulb in accordance with the present invention comprises a fastener 10 and a mounting unit.

Figure 2:
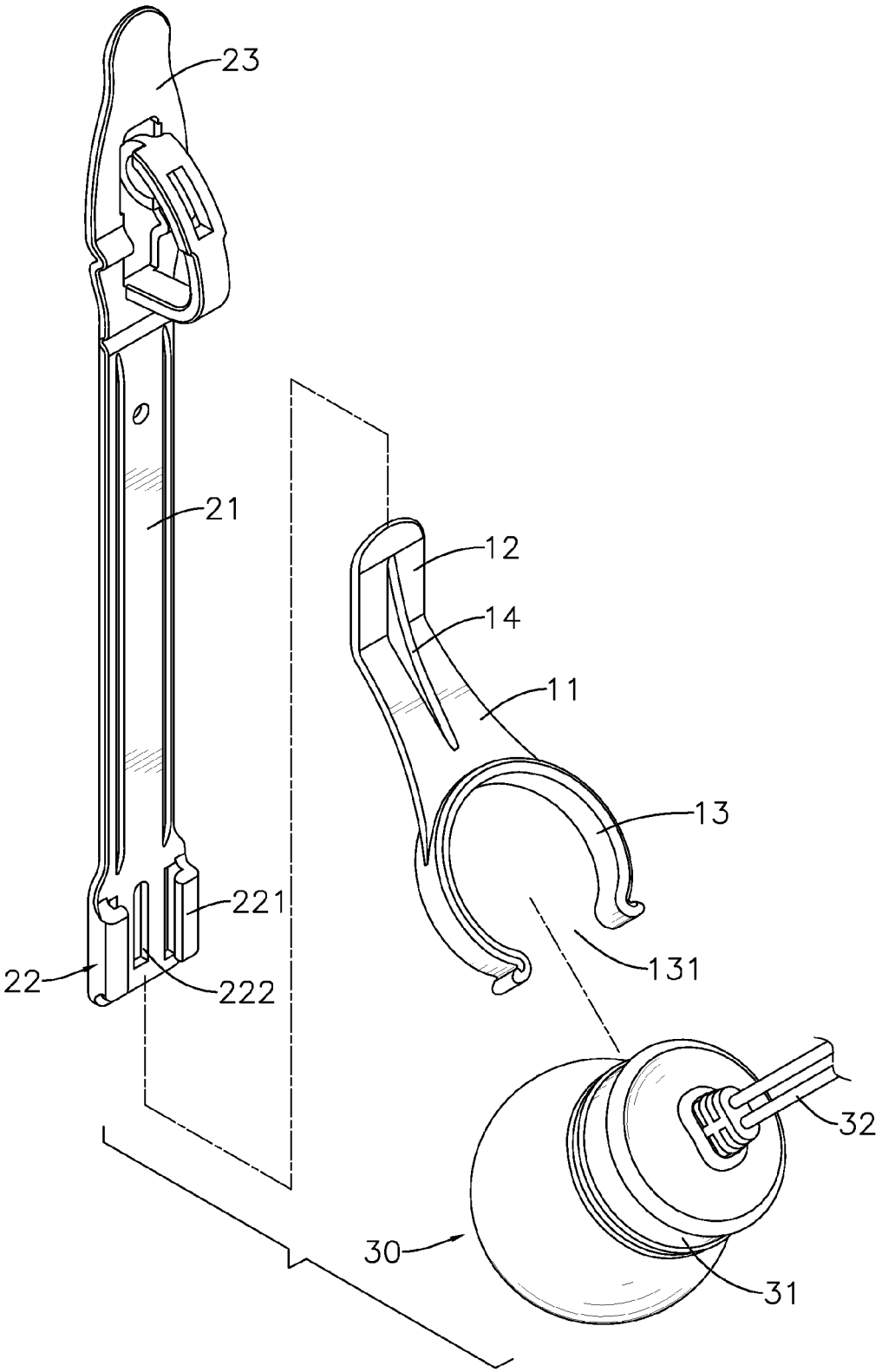
FIG. 2 is an exploded perspective view of the mounting carrier in FIG. 1.
Figure 3:
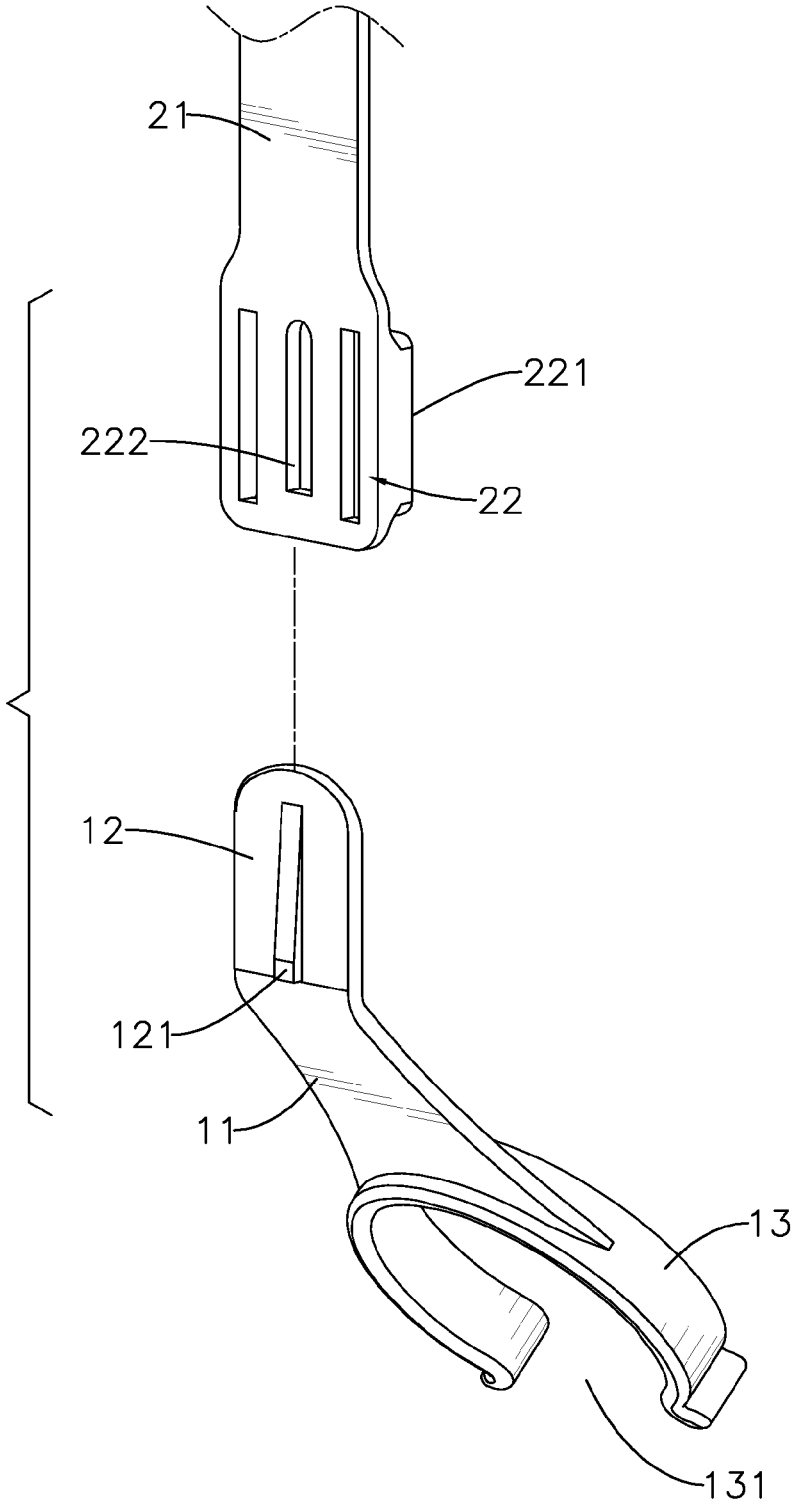
FIG. 3 is a partially exploded perspective rear view of the mounting carrier in FIG. 1.

With reference to FIGS. 2 and 3, the fastener 10 as described has a connecting panel 11, an engaging portion 12, a holding ring 13 and a fastening rib 14. The engaging portion 12 is elongated, is formed on one end of the connecting panel 11, and has a slant protrusion 121 formed obliquely on a bottom surface of the engaging portion 12. The thickness of the slant protrusion 121 decreases gradually from one end to the other end of the slant protrusion 121. The holding ring 13 is mounted on another end of the connecting panel 11 and has an opening 131. The fastening rib 14 is formed on a front surface of the connecting panel 11 and a front surface of the engaging portion 12.

As a better embodiment, the engaging portion 12 of the fastener 10 has multiple shapes of being a clip clamped on two surfaces of a desk, a hanger hung on a wall or a fixture nailed to a surface.

Figure 4:
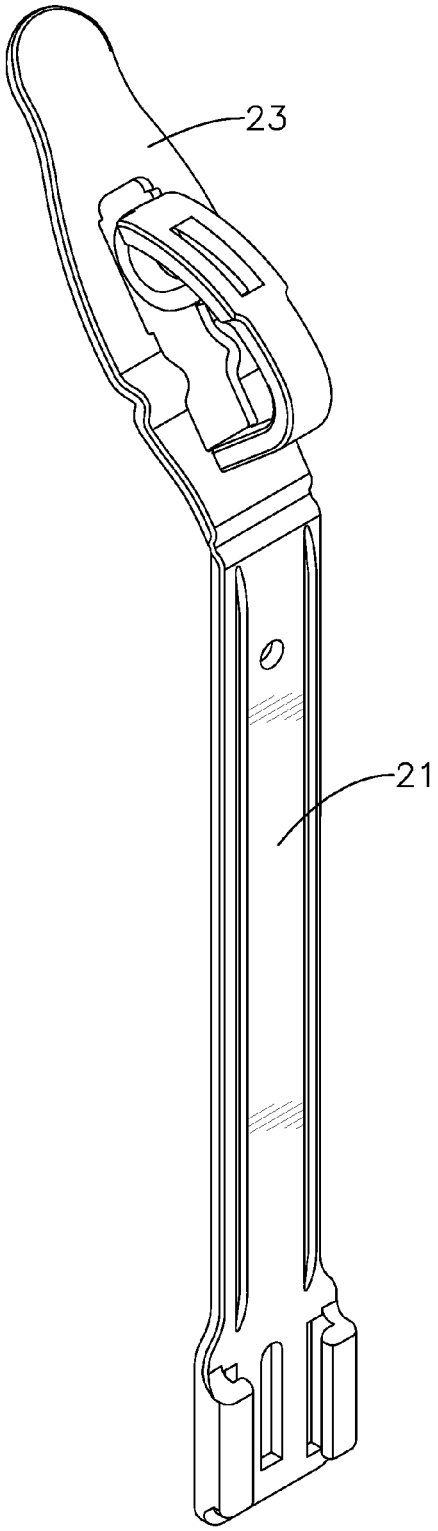
FIG. 4 is an operational view of adjusting a hook of the mounting carrier in FIG. 1.
Figure 5:
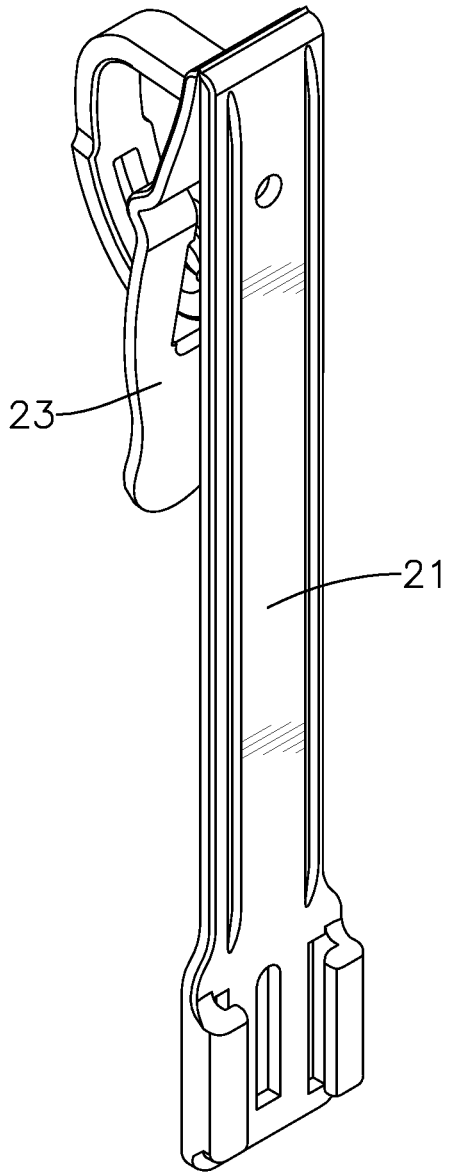
FIG. 5 is another operational view of adjusting the hook of the mounting carrier in FIG. 1.

With reference to FIGS. 2 and 3, in one embodiment, the mounting unit may be a hook 20 connecting to the fastener 10. The hook 20 has an elongated body 21, a connecting portion 22 and a hanging portion 23. The connecting portion 22 is mounted on one end of the elongated body 21, and has two blocking lumps 221 and a fastening hole 222. The blocking lumps 221 are formed on two opposite edges of the connecting portion 22. The fastening hole 222 is formed on the connecting portion 22 between the blocking lumps 221. The engaging portion 12 is fastened with the connecting portion 22 and is held by the blocking lumps 221. The slant protrusion 121 of the engaging portion 12 engages the fastening hole 222. The hanging portion 23 is mounted pivotally on the other end of the elongated body 21. With reference to FIGS. 4 and 5, the angle between the hanging portion 23 and the elongated body 21 is adjustable.

Figure 7:
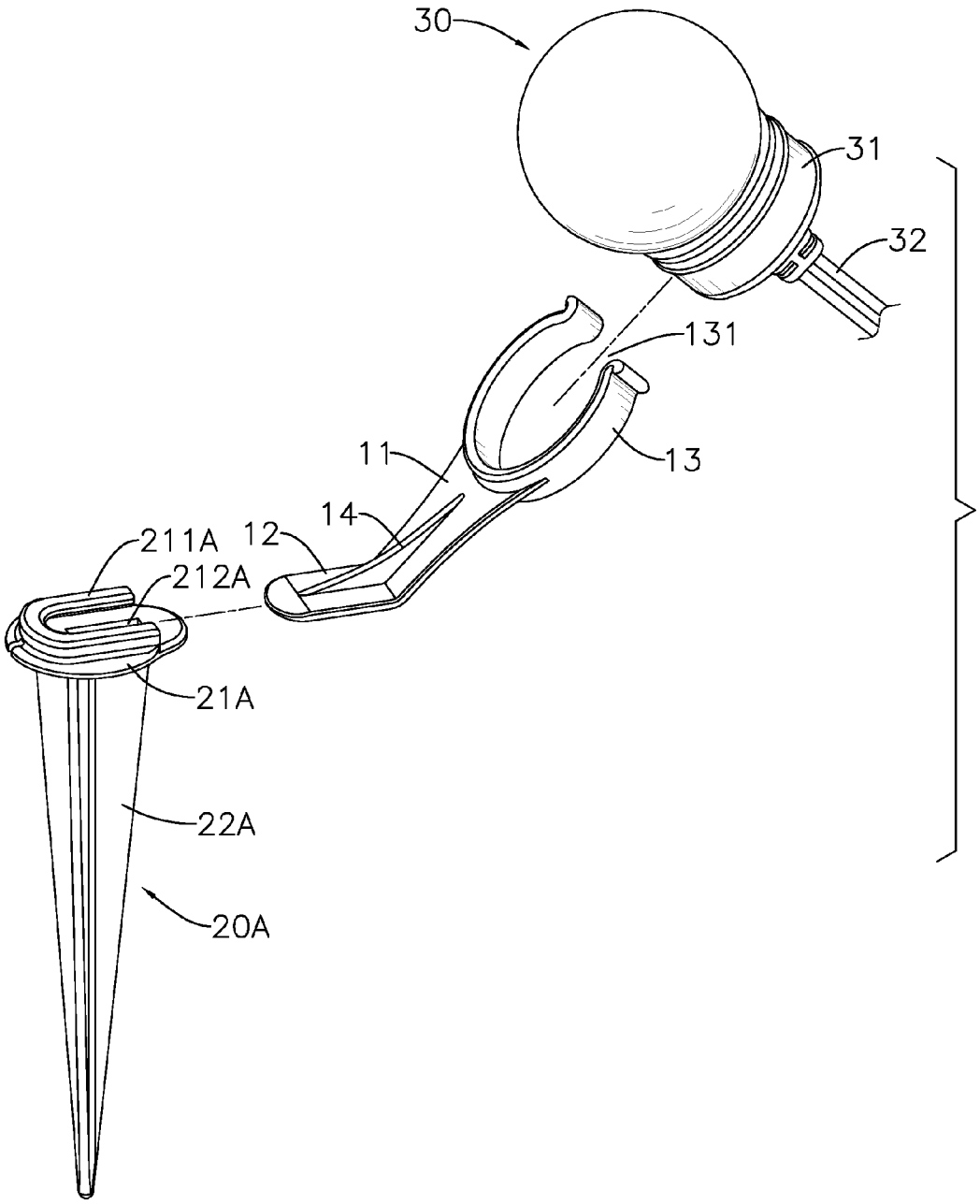
FIG. 7 is an exploded perspective view of the mounting carrier in FIG. 6.

With reference to FIGS. 6 and 7, in another embodiment, the mounting unit may be an insert 20A that connects to the fastener 10. The insert 20A has a connecting portion 21A and a thrusting portion 22A. The connecting portion 21A has a blocking lump 211A and a fastening hole 212A. The fastening hole 212A is formed on the connecting portion 21A. The blocking lump 211A is formed on the connecting portion 21A and around the blocking lump 211A. The engaging portion 12 is fastened with the connecting portion 21A and covered and limited by the blocking lump 211A, and the slant protrusion 121 of the engaging portion 12 engages the fastening hole 212A. The thrusting portion 22A extends in a cone shape on a bottom side of the connecting portion 21A.

The slant protrusion 121 of the engaging portion 12 is designed with an oblique angle for engaging the fastening hole 222, 212A. When installing the engaging portion 12, at first mounting the thin side of the slant protrusion 121 in a space of the connecting portion 22 or the thrusting portion 22A, then buckling the thick side of the slant protrusion 121 into the fastening hole 222, 212A.

With reference to FIGS. 1 and 6, in use, a bulb base 31 of a bulb 30 is clamped by the holding ring 13 of the fastener 10. Then the engaging portion 12 of the fastener 10 is connected to the hook 20 or the insert 20A. When the hook 20 is connected, the bulb 30 can be hung on a wall or an eave for illumination. When the insert 20A is connected, the bulb 30 can be inserted in the grass or a ground by the thrusting portion 22A for night illumination in a camping site or a parterre. The electricity is transmitted via a wire 32 connected to the bulb 30.

When connected to the bulb 30, the mounting carrier of the present invention can be applied to different terrains with ease of mounting and disassembly, thereby expanding the applications of the bulb 30.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mounting carrier for a bulb comprising:
- a fastener having a connecting panel with two ends
- an engaging portion being elongated, formed on one end of the connecting panel, and having
  - a slant protrusion formed on a bottom surface of the engaging portion, and a thickness of the slant protrusion decreasing gradually from an end to another end of the slant protrusion; and
  - a holding ring mounted on the other end of the connecting panel and having an opening; and
- a mounting unit being an insert connected to the fastener and having
  - a connecting portion mounted on an end of the mounting unit and having
    - a blocking lump formed on the connecting portion and holding and limiting the engaging portion; and
    - a fastening hole formed on a top of the connecting portion and engaged with the slant protrusion of the engaging portion; and
  - a thrusting portion formed on a bottom side of the connecting portion of the insert;

wherein
- the blocking lump is formed around the fastening hole; and
- the engaging portion of the fastener is fastened with the connecting portion of the mounting unit and is covered and limited by the blocking lump of the mounting unit.

2. The mounting carrier for a bulb as claimed in claim 1, wherein the thrusting portion is in a cone shape.

3. The mounting carrier for a bulb as claimed in claim 2, wherein the fastener has a fastening rib formed respectively on a front surface of the connecting panel and a front surface of the engaging portion.

4. A mounting carrier for a bulb comprising:
- a fastener having
  - two ends; and
  - an engaging portion mounted on one of the ends of the fastener and having a slant protrusion formed on a bottom surface of the engaging portion; and
  - a holding ring mounted on the other end of the fastener; and
- a mounting unit being a hook connected to the fastener and having
  - an elongated body;
  - a connecting portion mounted on an end of the mounting unit and having two blocking lumps respectively formed on two opposite edges of the connecting portion and holding and limiting the engaging portion; and
  - a fastening hole formed on a top of the connecting portion between the blocking lumps and engaged with the slant protrusion of the engaging portion; and
- a hanging portion mounted pivotally on an end of the elongated body;

wherein the engaging portion of the fastener is fastened with the connecting portion of the mounting unit and is held by the blocking lumps of the mounting unit.

5. The mounting carrier for a bulb as claimed in claim 4, wherein
- the fastener has a connecting panel;
- the engaging portion of the fastener is elongated and is formed on an end of the connecting panel, wherein a thickness of the slant protrusion decreases gradually from an end to another end of the slant protrusion; and
- the holding ring of the engaging portion of the fastener is mounted on another end of the connecting panel and has an opening.

6. The mounting carrier for a bulb as claimed in claim 5, wherein the fastener has a fastening rib formed respectively on a front surface of the connecting panel and a front surface of the engaging portion.

* * * * *